US010520275B2

(12) United States Patent
Ma

(10) Patent No.: US 10,520,275 B2
(45) Date of Patent: Dec. 31, 2019

(54) TOY FOR DISCHARGING A LIQUID

(71) Applicant: Alex Brands Buzz Bee Toys (HK) Limited, Kowloon (HK)

(72) Inventor: Chor-Ming Ma, Kowloon (HK)

(73) Assignee: Hong Kong Applied Science And Technology Research Institute Company Limited, Shatin, N.T. (HK)

( * ) Notice: Subject to any disclaimer, the term of this patent is extended or adjusted under 35 U.S.C. 154(b) by 0 days.

(21) Appl. No.: 15/782,952

(22) Filed: Oct. 13, 2017

(65) Prior Publication Data

US 2019/0113301 A1 Apr. 18, 2019

(51) Int. Cl.
*F41B 9/00* (2006.01)

(52) U.S. Cl.
CPC ..... *F41B 9/004* (2013.01); *F41B 9/0071* (2013.01); *F41B 9/0075* (2013.01); *F41B 9/0081* (2013.01)

(58) Field of Classification Search
CPC ..... F41B 9/0037; F41B 11/89; F41B 9/004; F41B 9/0071; F41B 9/0075; F41B 9/0081
USPC ..... 222/79
See application file for complete search history.

(56) References Cited

U.S. PATENT DOCUMENTS 5,662,244 A * 9/1997 Liu ..... F41B 9/0037 222/153.13
9,784,524 B1 * 10/2017 Ma ..... F41B 7/003
2011/0315710 A1 * 12/2011 Ma ..... F41B 9/0037 222/79

* cited by examiner

*Primary Examiner* — Paul R Durand
*Assistant Examiner* — Robert K Nichols, II

(57) ABSTRACT

The invention relates to a toy for discharging a liquid. The toy comprises a discharging chamber adapted to receive a liquid from a liquid storage tank; an outlet arranged at the discharging chamber adapted to discharge at least some of the liquid received in the discharging chamber, the outlet being controllable by a covering mechanism movable between a closed position and an open position to thereby close and open the outlet, respectively; a movable member operably connected with the covering mechanism; wherein, in response to a triggering action of the toy, the movable member is movable from a first position to a second position thereby actuating the covering mechanism to move from the closed position to the open position, and at the same time, triggering discharge of the at least some of the liquid from the discharging chamber via the outlet.

18 Claims, 10 Drawing Sheets

TOY FOR DISCHARGING A LIQUID

FIELD OF THE INVENTION

The invention relates to a toy and, particularly, but not exclusively, to a toy gun adapted to discharge a liquid such as water.

BACKGROUND OF THE INVENTION

A variety of water discharging toys such as, but not limited to, water firing toy guns of various types are available in the market. Particularly, toy water guns have been designed with functional features in order to enhance the experience of the user during the firing of water. For example, traditional toy water guns have been modified to discharge a stronger jet of water, such as with higher speed and/or stronger pressure. Various flow control or water discharging mechanisms have been attempted and developed to further improve operation of toy water guns.

OBJECTS OF THE INVENTION

An object of the present invention is to provide a toy for discharging a liquid.

Another object of the present invention is to provide a device for controlling a discharge of a liquid.

A further object of the present invention is to mitigate or obviate to some degree one or more problems associated with known liquid emitting toys, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a toy for discharging a liquid. The toy gun comprises a discharging chamber adapted to receive a liquid from a liquid storage tank; an outlet arranged at the discharging chamber adapted to discharge at least some of the liquid received in the discharging chamber, the outlet being controllable by a covering mechanism movable between a closed position and an open position to thereby close and open the outlet, respectively; a movable member operably connected with the covering mechanism; wherein, in response to a triggering action of the toy, the movable member is movable from a first position to a second position thereby actuating the covering mechanism to move from the closed position to the open position, and at the same time, triggering discharge of the at least some of the liquid from the discharging chamber via the outlet.

In a second main aspect, the invention provides a device for controlling a discharge of a liquid. The device comprises a discharging chamber adapted to receive a liquid; an outlet arranged at the discharging chamber adapted to discharge at least some of the liquid received in the discharging chamber, the outlet being controllable by a covering mechanism movable between a closed position and an open position to thereby close and open the outlet, respectively; a movable member operably connected with the covering mechanism; wherein, in response to a triggering action of the device, the movable member is movable from a first position to a second position thereby actuating the covering mechanism to move from the closed position to the open position, and at the same time, triggering discharge of the at least some of the liquid from the discharging chamber via the outlet.

The present invention is advantageous in that it provides a simple mechanism to control discharge of a liquid from a toy such as a toy gun. Unlike many of the traditional water discharging toy guns in the market, the liquid controlling mechanism of the present invention is provided or located outside of the liquid discharging chamber. Particularly, the opening and closing of the control mechanism are determined by the positioning or movement of a movable member which is operably connected with the trigger of the toy gun, as well as the control mechanism. The special configuration and arrangement of the present invention has successfully avoided or reduced any water turbulence created or restriction to the water flow by the check valve commonly located within the discharging cylinder of the traditional water guns, and thus enables a faster and more powerful water jet to be discharged by the gun to enhance the user's experience.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1A:
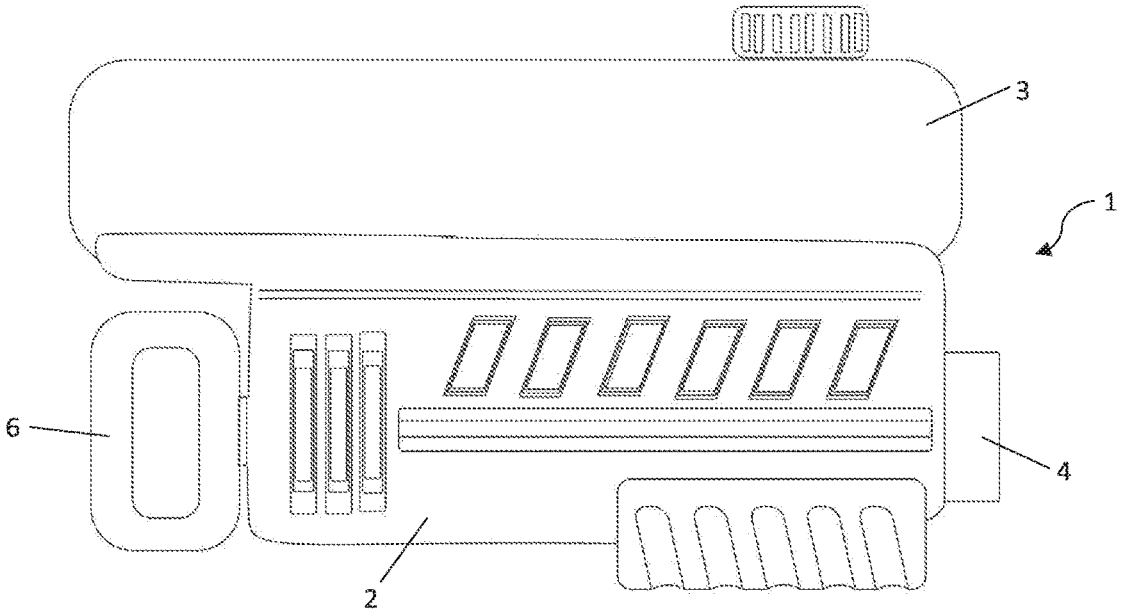
FIG. 1A is a side, external view showing a toy gun of the prior art.
Figure 1B:
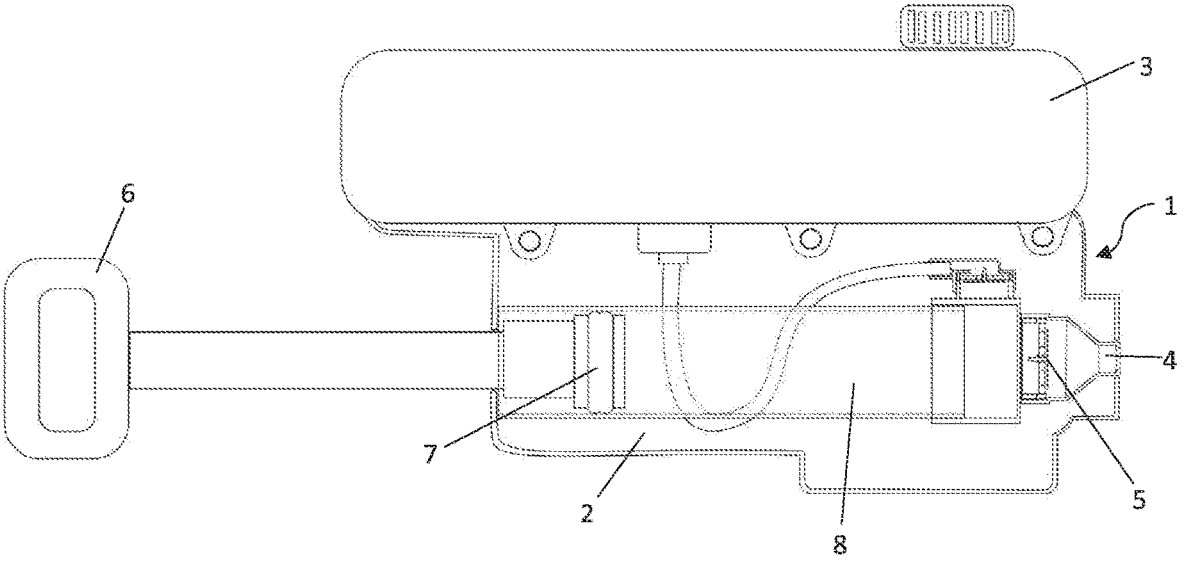
FIG. 1B is a side, internal view showing the toy gun of FIG. 1A.

FIGS. 1A and 1B generally show a liquid discharging toy gun 1 of the prior art having a gun housing 2 fluidly connected with a liquid storage tank 3. The toy gun 1 comprises a piston 7 and a cylinder 8 for receiving a portion of the liquid stored in the storage tank 3. Upon operation of a triggering handle 6 connected with the piston 7 by, for example, a reciprocal pumping action (i.e. pulling and pushing) by the user of the piston 7, the cylinder 8 can be arranged to discharge the portion of the stored liquid from a nozzle 4 via a valve member 5 positioned between the nozzle 4 and the cylinder 8. However, the passing of the water through the valve member 5 will unavoidably restrict the flow of the ejected water, and thus the speed and power of the water jet discharged from the nozzle 4.

Figure 2A:
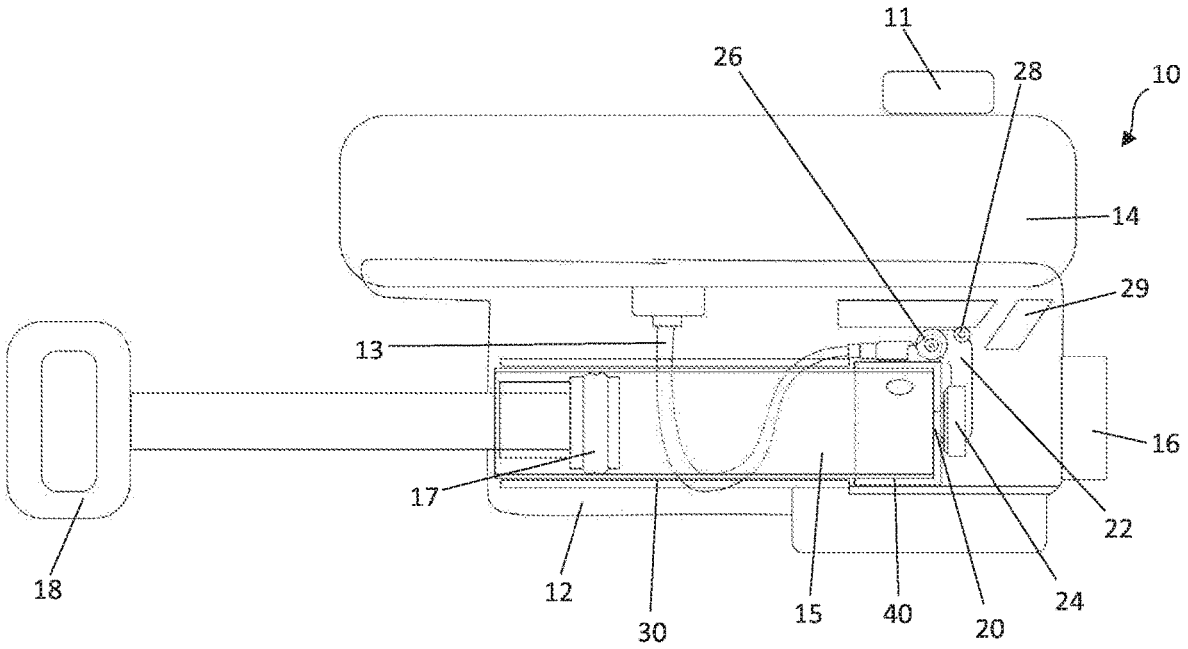
FIG. 2A is a side, internal view of a toy gun in accordance with an embodiment of the present invention.

Referring to FIG. 2A, shown is a liquid discharging toy in the form of a toy gun 10 according to an embodiment of the present invention. The toy gun 10 can be generally configured with a gun body 12; a liquid storage tank 14 fluidly connected with the gun body 12 and adapted to be filled via a tank opening 11; a nozzle 16 for discharging at least some of the liquid from the gun body 12, and a trigger 18 for triggering discharge of the liquid by the user. Particularly, the gun body 12 may comprise a discharging chamber 15 fluidly connected with the liquid storage tank 14 via one or more conduits 13 to receive some liquid from the liquid storage tank 14, and an outlet 20 arranged at the discharging chamber 15 for discharging at least some of the liquid received in the chamber 15. The outlet 20 is adapted to be controlled by a covering mechanism 22 movable between a closed position and an open position to thereby close and open the outlet 20, respectively. A front view of the covering mechanism 22 is further shown in FIG. 2B.

Specifically, the toy gun 10 may further comprise a movable member 30 operably connected with the covering mechanism 22 such that, in response to a triggering action of the toy gun 10, the movable member 30 is movable from a first position to a second position thereby actuating the covering mechanism 22 to move from the closed position to the open position, and at the same time, triggering discharge of the liquid stored in the discharging chamber 15 via the outlet 20.

In the context of the present description, the term "movable member" can take a broad meaning which may encompass any one or more parts, units or modules adapted to be mechanically linked, connected, engaged or operable with the covering mechanism, such that in response to a triggering action, the movable member is movable to thereby actuate the covering mechanism to close or open the outlet, and at the same time, trigger the discharge of liquid from the discharging chamber via the outlet. The "movable member" shall therefore not be limited to any one or more of the described embodiments, and a person skilled in the art would appreciate that any other movable means or parts which are capable of achieving the same purpose without deviating from the scope of the present invention, shall also be encompassed.

The triggering action may comprise a movement of the trigger 18 by, for example, a user of the toy gun in a reciprocal pumping action along the horizontal or longitudinal axis of the gun body 12, such as pulling of the trigger 18 away from the nozzle 16, and then pushing of the trigger 18 towards the nozzle 16 thereby causing the movable member 30 to move relative to the gun body 12, and preferably, to move along the same direction of movement as the triggering action or the trigger 18. In other words, when the trigger 18 is pulled away from the nozzle 16 by the user, the movable member 30 will be caused to move away from the nozzle 16 relative to the body 12; and when the trigger 18 is then pushed towards the nozzle 16, the movable member will also be caused to move towards the nozzle 16 relative to the body 12.

More specifically, the trigger 18 is movable between a first triggering position and a second triggering position to enable the movable member 30 to move between the first position and the second position, respectively, which in turn actuates the covering mechanism 22 to move between the closed position and the open position, respectively. At the same time, movement of the trigger 18 triggers discharge of the liquid stored in the discharging chamber 15 via the outlet 20.

Figure 2B:
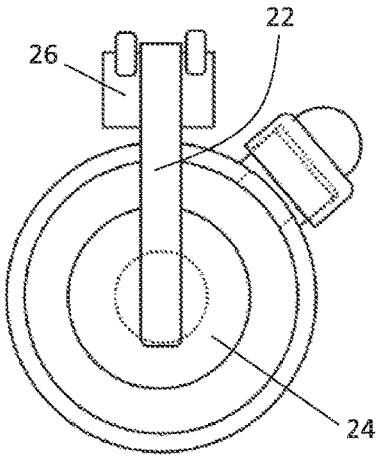
FIG. 2B is a front view of a covering mechanism being shown in FIG. 2A.

In the embodiment as shown in FIG. 2A, a piston member 17 can be arranged at a distal end of the trigger 18 to slidably engage an internal wall of the discharging chamber 15 for a substantially fluid-tight sliding movement therebetween. In this embodiment, the movable member 30 can be provided in the form of or comprise a housing 40 of the discharging chamber 15 pivotally connected with a covering means 24 of the covering mechanism 22, such that when the housing 40 is movable between the first position and the second position in response to the triggering action, the covering mechanism 22 can be pivoted between the closed position and the open position to thereby close and open the outlet 20, respectively. The pivotal movement of the covering mechanism 22 can be achieved by any known pivot joints, such as but not limited to, a hinged joint 26 as shown in FIG. 2B. The covering mechanism 22 may further comprise one or more rollers 28 adapted to engage a block member 29 arranged in the gun body 12. Specifically, when the housing 40 is arranged to move from the first position to the second position, i.e. towards the direction of the nozzle 16 as in this embodiment, the one or more rollers 28 are pushed against the block member 29 and are forced to roll or slide up and along an upwardly inclined surface of the block member 29. The abutting of the rollers 28 against the inclined face of the block member 29 thus forces the hinged joint 26 to pivot the covering means 24 and thus, opens the outlet 20. Optionally, the covering mechanism 22 may comprise a biasing means (not shown) to bias the covering means 24 normally towards the closed position. The covering means 24 may further comprise a sealing member (not shown) to provide a leak-proof closure of the outlet 20 by the covering means 24.

Figure 3A:
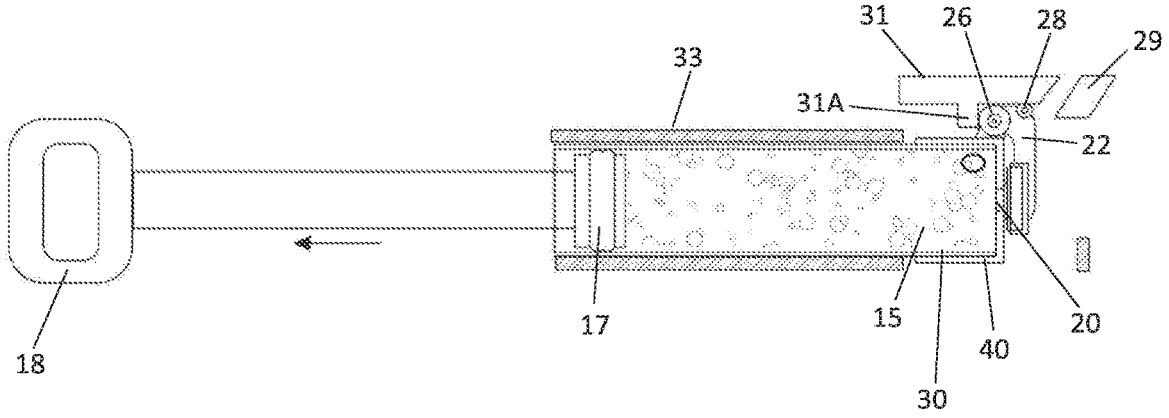
FIGS. 3A to 3G show the operating steps of the toy gun of FIG. 2.

Detailed operating steps of the toy gun 10 as embodied in FIG. 2A are further illustrated in FIGS. 3A to 3G. Referring to FIG. 3A, the trigger 18 is first pulled backward to fill the discharging chamber 15 with water. Particularly, with the outlet 20 being closed by the covering means 24, the backward pulling action of the trigger 18 creates a negative pressure in the discharging chamber 15 which draws water from the liquid storage tank 14 into the chamber 15. During the fill operation, the movable member 30, which comprises the housing 40 of the discharging chamber 15 in this embodiment, is at its rearmost position relative to the gun body 12. The movable member 30, which may be slidably supported by a sleeve 33, may be prevented from further rearward movement relative to the gun body 12 or sleeve 33 by the engagement of the hinged joint 26 abutting a stop member 31A of a rearward block member 31. The rearward block member 31 has a fixed position relative to the gun housing 12.

Figure 3B:
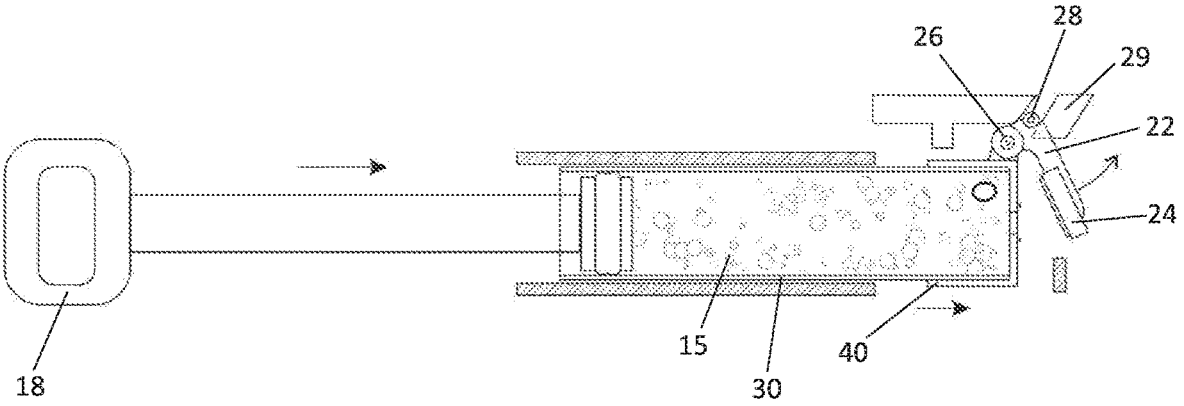
Figure 3C:
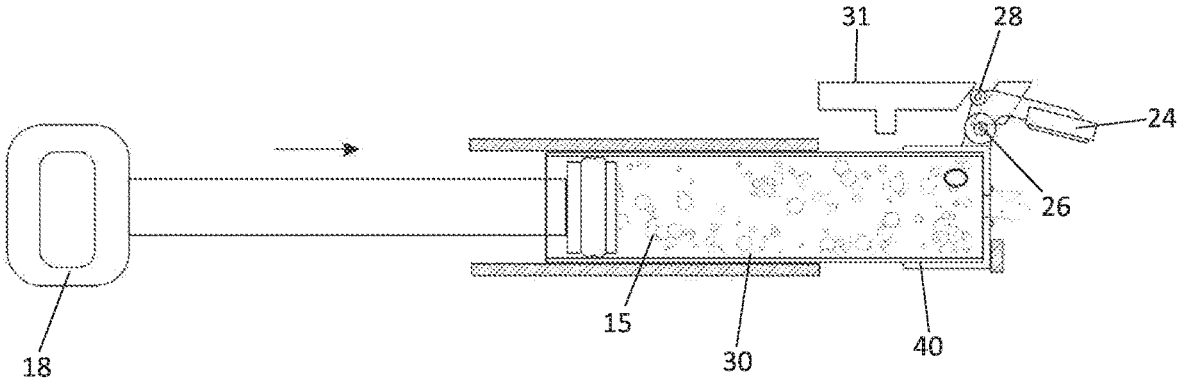
Figure 3D:
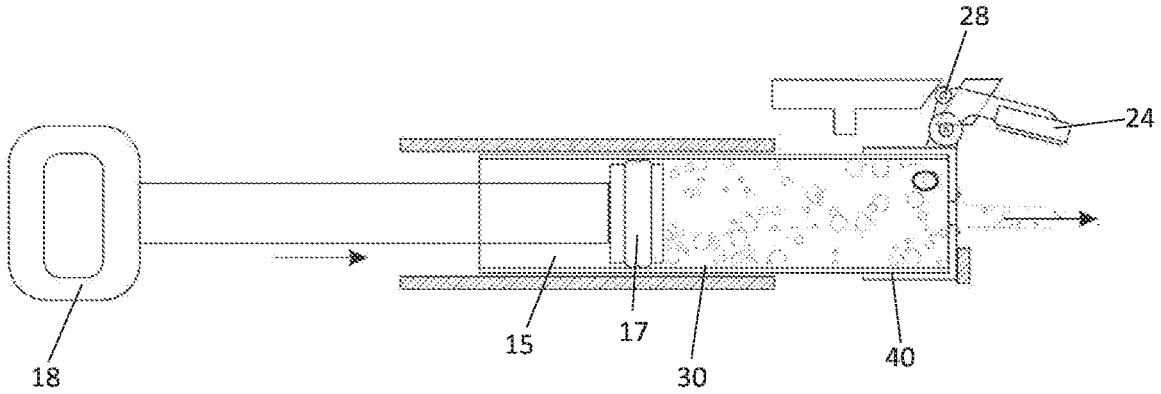
Figure 3E:
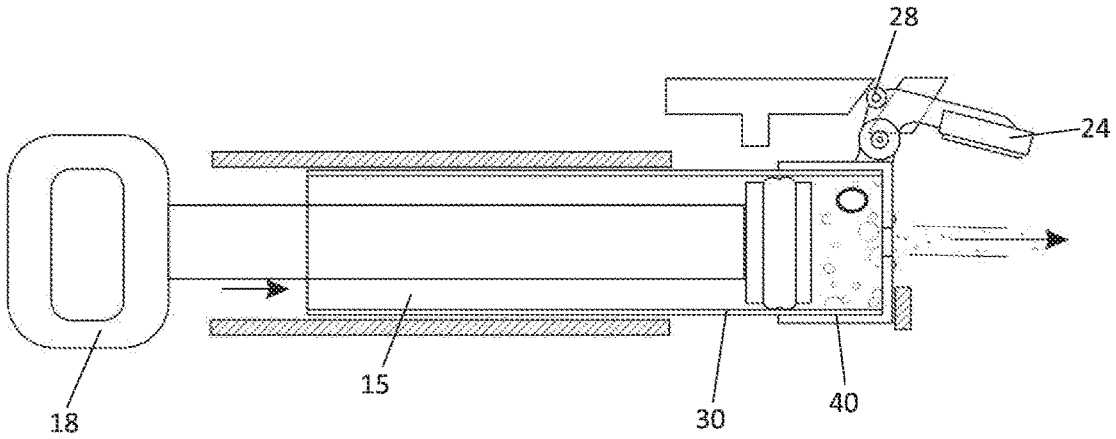

To discharge the water from the chamber 15, the trigger 18 is pushed forward which causes the movable member 30 to move along the same direction of movement as the trigger 18 relative to the gun body 12. The forward movement of the housing 40 relative to the gun body 12 forces the roller 28 to slide or roll upward and along the inclined face of the forward block member 29, which causes the covering means 24 of the covering mechanism 22 to pivot open, as shown in FIGS. 3B and 3C. The forward block member 29 has a fixed position relative to the gun body 12. Further pushing or forward movement of the trigger 18 pushes the piston member 17 to advance along the discharging chamber 15 and consequently, forces at least some of the stored water out of the chamber 15 via the opened outlet 20 under pressure, as shown in FIGS. 3D and 3E.

Figure 3F:
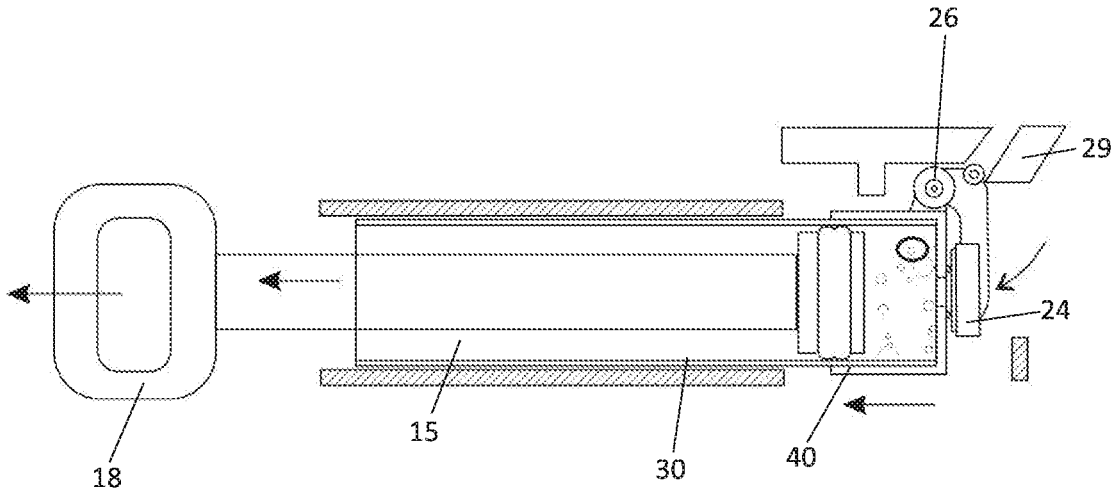
Figure 3G:
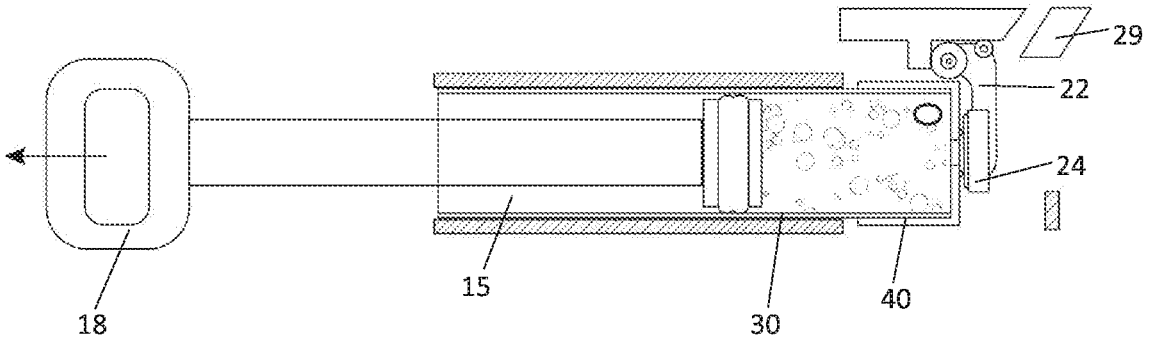

To recharge the discharging chamber 15 with water, the trigger 18 will be drawn backward which returns the housing 40 along the same direction. The backward movement of the housing 40 disengages the roller 28 from the forward block member 29, which allows the covering mechanism 22 to pivot and restore its closed position. Restoration of the covering mechanism to its closed position may be solely due to the biasing means and/or may be assisted by the roller 28 engaging an inclined surface of the rearward block member 31. The outlet 20 is thus closed by the covering means 24. Any further backward movement of the trigger 18 creates the required negative pressure which draws water from the liquid storage tank 14 to refill the discharging chamber 15 as seen in FIGS. 3F and 3G.

Figure 4A:
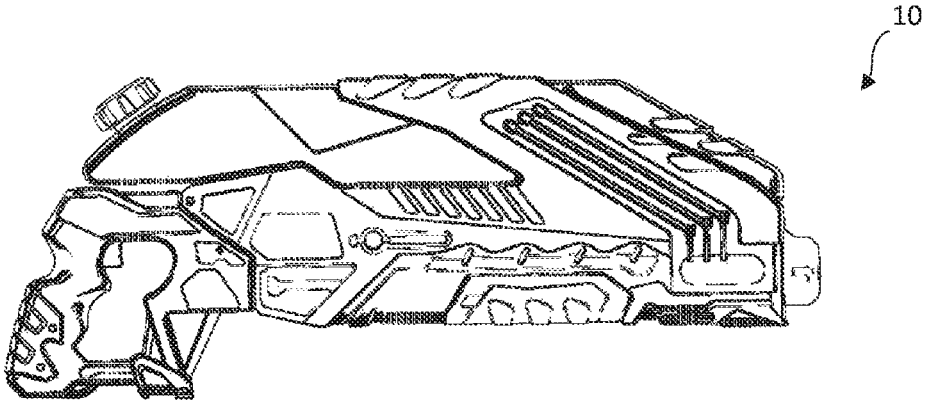
FIG. 4A is a side, external view of a toy gun in accordance with another embodiment of the present invention.
Figure 4B:
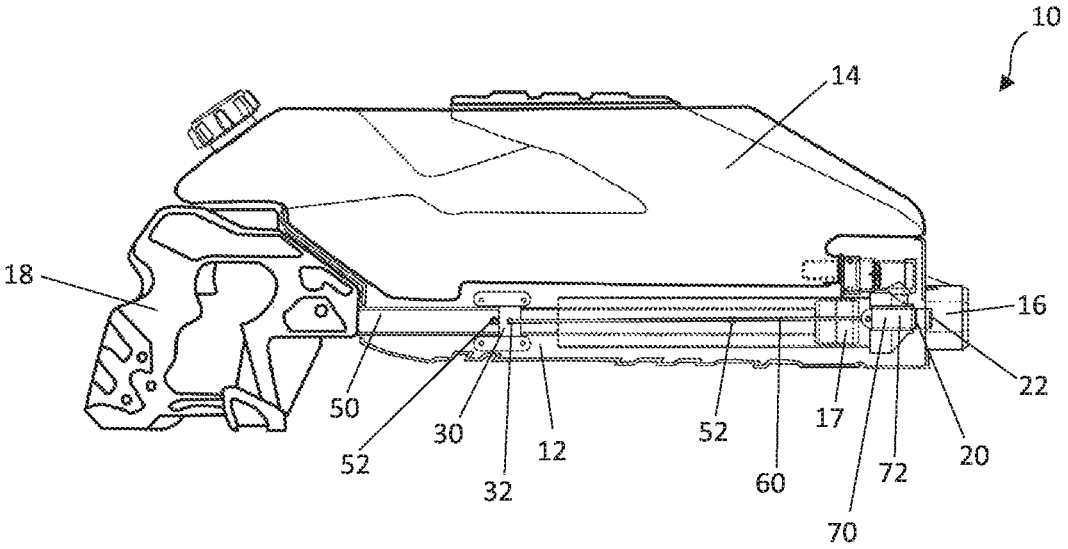
FIG. 4B is a side, internal view of the toy gun of FIG. 4A.

Referring to FIGS. 4A and 4B, shown is another embodiment of the toy gun 10 in accordance with the present invention. In this embodiment, the movable member 30 can be provided in the form of or comprise a slide member 32 slidably movable along a base member 50 connected with the trigger 18. In one embodiment, the base member 50 can be configured in the form of a rail 50 having at least two positioning members 52 spaced apart at a predetermined distance along a length of the rail 50, with the slide member 32 being movably arranged between the two positioning members 52 on the rail 50. For example, the slide member 32 can be prepared in the form of a slider plate movably clamped on the rail 50 and between the two positioning members 52. Particularly, upon movement of the rail 50, each of the two positioning members is adapted to abut a corresponding, lateral side of the slide member 32 thereby causing the slide member 32 to move in the same direction of movement as the rail 50.

Figure 5A:
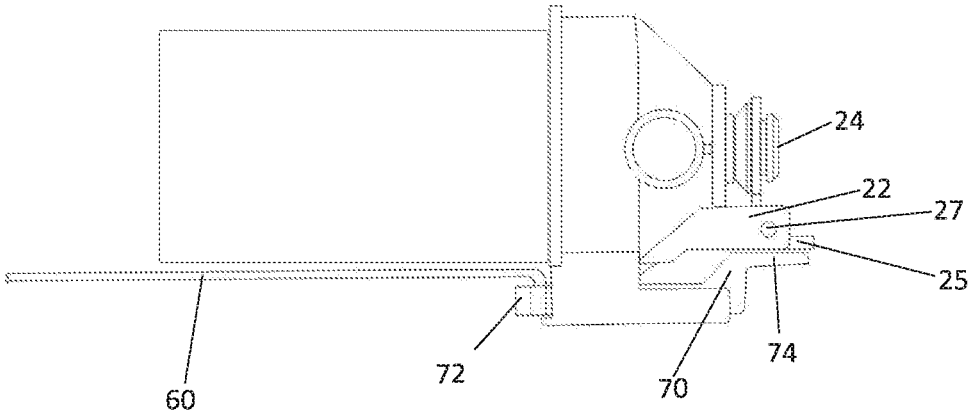
FIG. 5A is a magnifying view showing a switch member of the toy gun of FIG. 4B, with the switch member being arranged to actuate the covering mechanism to a closed position.
Figure 5B:
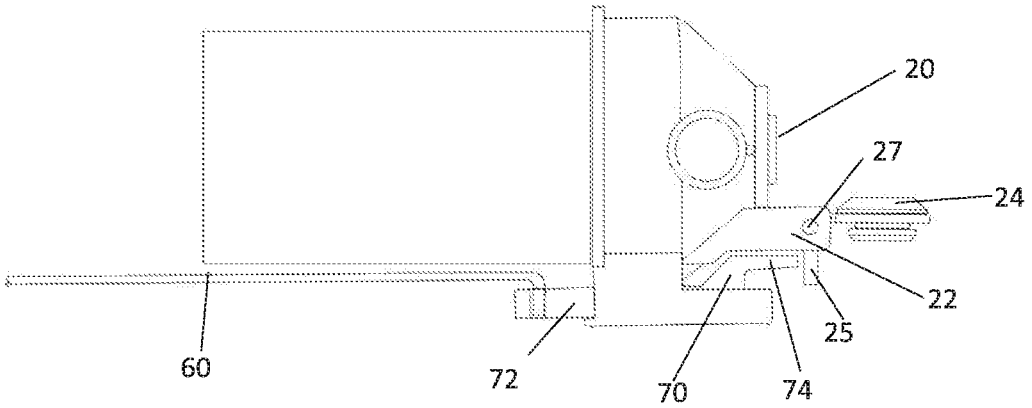
FIG. 5B is a magnifying view showing the switch member of the toy gun of FIG. 4B, with the switch member being arranged to actuate the covering mechanism to an open position.

In the embodiment as shown in the figures, the slide member 32 is further arranged to link or connect with a switch member 70 via a linkage 60, which are shown more clearly in FIGS. 5A and 5B. When the slide member 32 is caused to move by action of the trigger 18 and thus the positioning members 52 of the base member 50, the switch member 70 will in turn be caused to move to thereby actuate the covering mechanism 22 in moving between the closed and the open positions. Specifically, the switch member 70 may comprise a block member 72 movably engageable with a stopping member 25 of the covering mechanism 22, with the stopping member 25 being pivotally connected with the covering means 24 of the covering mechanism 22. For example, when the slide member 32 and thus the linkage 60 are caused to move in a direction towards the outlet 20, the block member 72 connected with the linkage 60 will also be made to move in the same direction. As shown in FIGS. 5A and 5B, the block member 72 can be configured with a protruding portion 74 at an end distal to the linkage 60 and adjacent the stopping member 25. When the block member 72 is caused to advance in a direction towards the outlet 20, the protruding portion 74 will eventually abut the stopping member 25, and any further forward movement of the protruding portion 74 along this direction will thus push the protruding portion 74 against the stopping member 25 to pivot the covering means 24 upward and to close the outlet 20, as shown in FIG. 5A. On the other hand, when the slide member 32, the linkage 60 and the linked block member 72 are caused to move in an opposite direction, i.e. away from the outlet 20, the protruding portion 74 of the block member 72 will be allowed to disengage from the stopping member 25 thereby releasing the outlet 20 from the covering means 24, as shown in FIG. 5B. Optionally, a biasing means such as a torsion spring (not known) can be provided at the pivot joint for the covering means 24 to remain open when the stopping member 25 is not abutted by the protruding portion 74, such that the discharge of the water jet will not be interfered by the covering means 24.

Figure 6A:
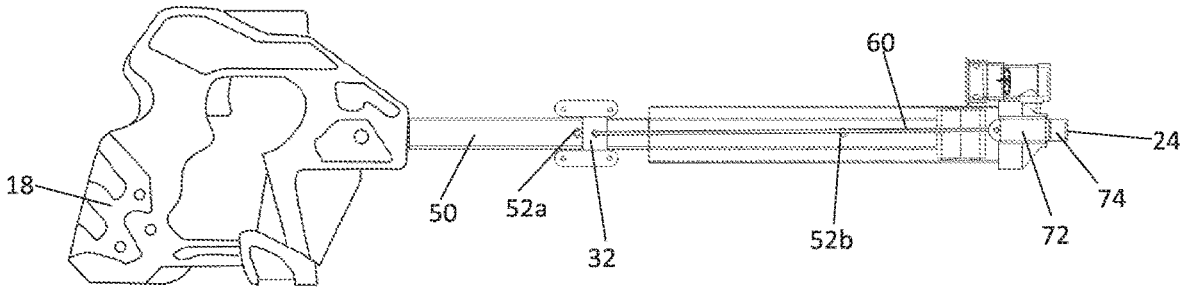
FIGS. 6A to 6F show the operating steps of the toy gun of FIG. 4B.
Figure 6B:
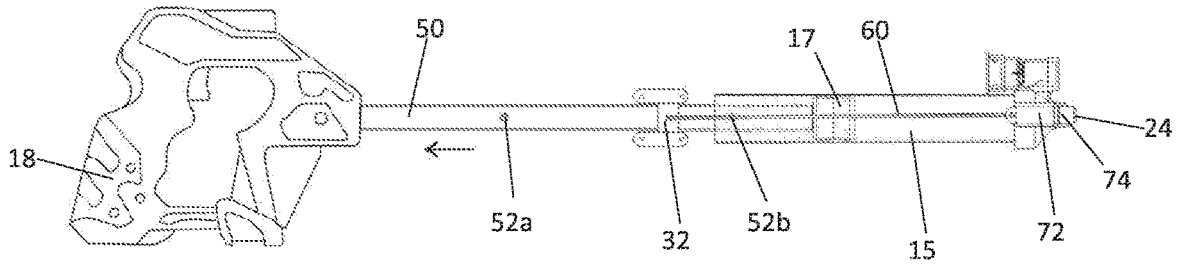

FIGS. 6A to 6F further illustrate the operating steps of the toy gun 10 of FIGS. 4A and 4B. Referring to FIGS. 6A and 6B, the covering mechanism 22 of the toy gun 10 is arranged in its closed position with the covering means 24 blocking the outlet 20. Pulling of the trigger 18 in a backward direction, i.e. away from the outlet 22 causes the connected base member or rail 50 to move in the same, backward direction as the movement direction of the trigger 18. The backward movement of the rail 50 also enables relative movement between the movable member 30, which is the slide member 32 in this embodiment, and the rail 50, and particularly, enables movement of the slide member 32 between the two positioning members 52*a* and 52*b* along the rail 50. As shown in the figures, movement of the trigger 18 will result in the positioning member 52*a* to depart from the slide member 32, and the positioning member 52*b* to approach the slide member 32. A piston member 17, which is arranged at an end of the rail 50 distal to the trigger 18, provides a substantially fluid-tight engagement with an internal wall of the discharging chamber 15. The backward pulling action of the trigger 18 thus develops a negative pressure within the chamber 15 which draws water from the liquid storage tank 14 of the toy gun 10 into the chamber 15.

Figure 6C:
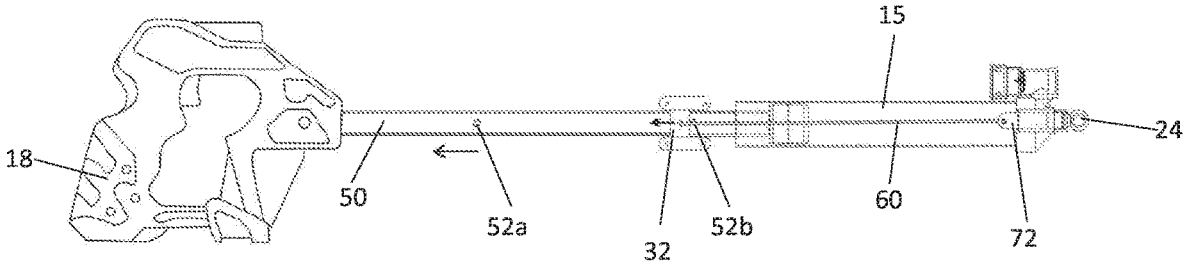
Figure 6D:
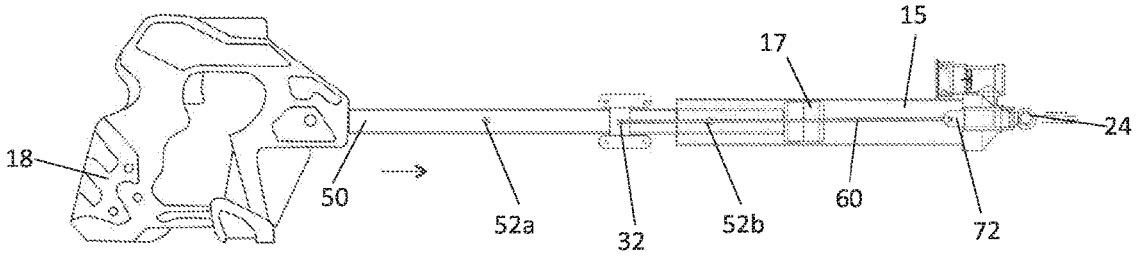

As shown in FIG. 6C, further backward movement of the rail 50 causes the positioning member 52*b* to abut the right lateral side of the slide member 32, and subsequently, push the slide member 32 to slide in the same, backward direction along the movement of the rail 50, as indicated by the small arrow in the figure. Since the slide member 32 is linked to the block member 72 of the switch member via the linkage 60, movement of the slide member 32 will cause the block member 72 to slide along the same backward direction. As a result, the protruding portion 74 of the block member 72 will be made to retract and to disengage with the stopping member 25 of the covering mechanism 22, thereby opening the covering means 24. A subsequent forward pushing action of the trigger 18 by the user thus discharges the stored water from the discharging chamber 15 via the outlet 20 as a water jet, as shown in FIG. 6D.

Figure 6E:
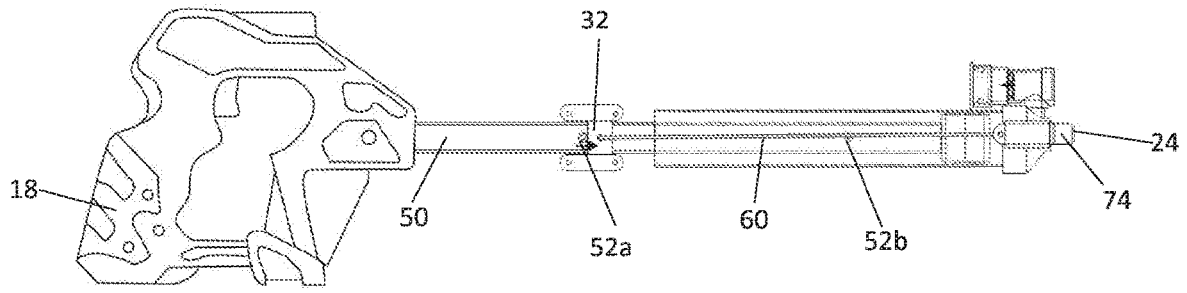
Figure 6F:
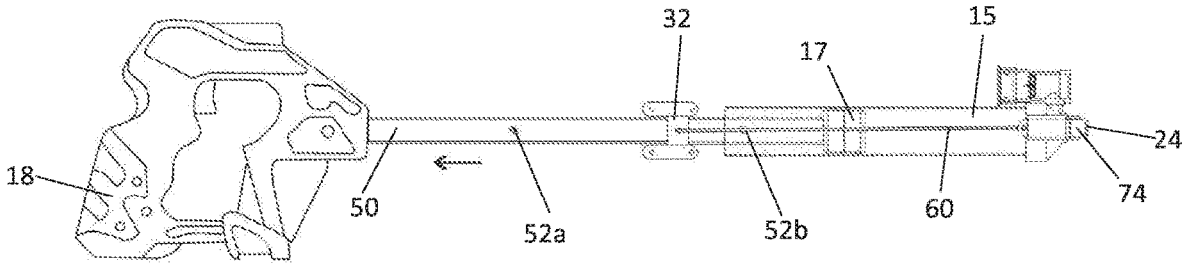

Referring to FIG. 6E, further forward movement of the trigger 18 will cause the positioning member 52*a* to abut the left lateral side of the slide member 32, and subsequently, push the slide member 32 to slide in the same, forward direction along the movement of the rail 50, as indicated by the small arrow in the figure. Forward movement of the slide member 32 will in turn cause the linked block member 72 to slide along the same forward direction, resulting in the protruding portion 74 to abut the stopping member 25 and pivot the covering means 24 to close the outlet 20. The cycle then repeats by pulling the trigger 18 backward to fill the discharging chamber 15 with water, as shown in FIG. 6F In a further aspect of the present invention, there is provided a device for controlling a discharge of a liquid, and particularly, a device for controlling liquid discharge in a toy. The device may comprise, as above described, a discharging chamber 15 adapted to receive a liquid; an outlet 20 arranged at the discharging chamber 15 adapted to discharge at least some of the liquid received in the discharging chamber 15, with the outlet 20 being controllable by a covering mechanism 22 movable between a closed position and an open position to thereby close and open the outlet 20, respectively. The device may further comprise a movable member 30 operably connected with the covering mechanism 22. In response to a triggering action of the device, the movable member 30 is movable from a first position to a second position thereby actuating the covering mechanism 22 to move from the closed position to the open position, and at the same time, triggering discharge of the at least some of the liquid from the discharging chamber 15 via the outlet 20.

Although the device is described in the present invention for controlling discharge of a liquid from a toy gun, it would be understood that application of the device shall not be restricted to the application in toys or toy guns. Instead, a person skilled in the art would appreciate that the device of the present invention is applicable in any other liquid discharging arrangements, as long as the applications do not deviate from the scope of the present invention.

The present invention is advantageous in that it provides a simple mechanism to control discharge of a liquid from a toy such as a toy gun. Unlike many of the traditional water discharging toy guns in the market, the liquid controlling mechanism of the present invention is provided or located outside of the liquid discharging chamber. Particularly, the opening and closing of the control mechanism are determined by the positioning or movement of a movable member which is operably connected with the trigger of the toy gun, as well as the control mechanism. The special configuration and arrangement of the present invention has successfully avoided or reduced any water turbulence created or restriction to the water flow by the check valve commonly located within the discharging cylinder of the traditional water guns, and thus enables a faster and more powerful water jet to be discharged by the gun to enhance the user's experience.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such prior art does not constitute an admission that the prior art forms a part of the common general knowledge in the art.

The invention claimed is:

1. A toy for discharging a liquid, comprising:

a discharging chamber adapted to receive a liquid from a liquid storage tank;

an outlet arranged at the discharging chamber adapted to discharge at least some of the liquid received in the discharging chamber, the outlet being controllable by a covering mechanism having a covering means movable between a closed position and an open position to thereby close and open the outlet, respectively;

a base member having a triggering means at one end, and a piston member at an opposing end distal to the triggering means; the piston member being arranged within the discharging chamber;

a movable member operably connected with the covering mechanism, the movable member being slidably arranged at and is movable along the base member;

wherein, in response to a pulling action of the triggering means, the piston member is movable with the base member thereby drawing liquid from the liquid storage tank to the discharging chamber, and the movable member is caused to move by movement of the base member from a first position to a second position thereby actuating the covering means to move from the closed position to the open position thereby allowing discharge of the at least some of the liquid from the discharging chamber via the outlet upon a subsequent pushing action of the triggering means.

2. The toy according to claim 1, wherein the triggering means is movable to cause movement of the movable member.

3. The toy according to claim 2, wherein the movable member is caused to move along a same direction of movement as the triggering means.

4. The toy according to claim 2, wherein the triggering means is movable between a first triggering position and a second triggering position to enable the movable member to move between the first position and the second position.

5. The toy according to claim 4, wherein the triggering means is movable from the first triggering position to the second triggering position to thereby discharge the at least some of the liquid via the outlet.

6. The toy according to claim 2, wherein the movable member comprises a slide member, the slide member being adapted to connect with a switch member such that, when the movable member is moved from the first position to the second position, the switch member actuates the covering means of the covering mechanism to move from the closed position to the open position.

7. The toy according to claim 6, wherein the switch member comprises a block member having a protruding portion engageable with the covering mechanism such that, when the protruding portion engages the covering mechanism, the covering means of the covering mechanism moves to the closed position.

8. The toy according to claim 1, wherein the base member having at least two positioning members arranged thereon and are spaced apart along the base member, with the movable member being movably arranged between the two positioning members on the base member.

9. The toy according to claim 1, wherein the piston member is slidably engageable with an internal wall of the discharging chamber.

10. The toy according to claim 1, further comprising a biasing means adapted to bias the covering means of the covering mechanism toward the open position.

11. A device for controlling a discharge of a liquid, comprising:

a discharging chamber adapted to receive a liquid;

an outlet arranged at the discharging chamber adapted to discharge at least some of the liquid received in the discharging chamber, the outlet being controllable by a covering mechanism having a covering means movable between a closed position and an open position to thereby close and open the outlet, respectively;

a base member having a triggering means at one end, and a piston member at an opposing end distal to the triggering means; the piston member being arranged within the discharging chamber;

a movable member operably connected with the covering mechanism, the movable member being slidably arranged at and is movable along the base member;

wherein, in response to a pulling action of the triggering means, the piston member is movable with the base member thereby drawing liquid from the liquid storage tank to the discharging chamber, and the movable member is caused to move by movement of the base member from a first position to a second position thereby actuating the covering means to move from the closed position to the open position thereby allowing discharge of the at least some of the liquid from the discharging chamber via the outlet upon a subsequent pushing action of the triggering means.

12. The device according to claim 11, wherein the movable member is caused to move by the triggering action along a same direction of movement as the base member.

13. The device according to claim 11, wherein the movable member comprises a slide member, the slide member being adapted to connect with a switch member such that, when the movable member is moved from the first position to the second position, the switch member actuates the covering means of the covering mechanism to move from the closed position to the open position.

14. The device according to claim 13, wherein the switch member comprises a block member having a protruding portion engageable with the covering mechanism such that, when the protruding portion engages the covering mechanism, the covering means of the covering mechanism moves to the closed position.

15. The device according to claim 11, wherein the piston member is slidably engageable with an internal wall of the discharging chamber.

16. The device according to claim 11, wherein the triggering means is movable to cause movement of the movable member.

17. The device according to claim 16, wherein the triggering means is movable between a first triggering position and a second triggering position to enable the movable member to move between the first position and the second position.

18. The device according to claim 17, wherein the triggering means is movable from the first triggering position to the second triggering position to thereby discharge the at least some of the liquid via the outlet.

* * * * *